US012747002B2

(12) United States Patent
Evans

(10) Patent No.: US 12,747,002 B2
(45) Date of Patent: Sep. 29, 2026

(54) UNMANNED TRANS-SURFACE VEHICLE

(71) Applicant: Carillon Technologies Management Corporation, Arlington, VA (US)

(72) Inventor: John David Evans, Arlington, VA (US)

(73) Assignee: Carillon Technologies Management Corporation, New Haven, CT (US)

( * ) Notice: Subject to any disclaimer, the term of this patent is extended or adjusted under 35 U.S.C. 154(b) by 818 days.

(21) Appl. No.: 17/786,261

(22) PCT Filed: Dec. 21, 2020

(86) PCT No.: PCT/US2020/066353

§ 371 (c)(1),
(2) Date: Jun. 16, 2022

(87) PCT Pub. No.: WO2021/127624

PCT Pub. Date: Jun. 24, 2021

(65) Prior Publication Data

US 2023/0023286 A1 Jan. 26, 2023

Related U.S. Application Data

(60) Provisional application No. 62/951,335, filed on Dec. 20, 2019.

(51) Int. Cl.

| | |
|---|---|
| ***B63B 1/26*** | (2006.01) |
| ***B63B 1/30*** | (2006.01) |
| ***B63B 7/00*** | (2020.01) |

(52) U.S. Cl.

CPC ..... *B63B 1/26* (2013.01); *B63B 1/30* (2013.01); *B63B 2007/003* (2013.01)

(58) Field of Classification Search

CPC .. B63B 1/00; B63B 1/24; B63B 1/246; B63B 1/26; B63B 1/28; B63B 2001/281;
(Continued)

(56) References Cited

U.S. PATENT DOCUMENTS 2,856,879 A * 10/1958 Baker ..... B63B 1/28 114/275
4,208,980 A * 6/1980 Henkel ..... B63B 1/28 114/274

(Continued)

FOREIGN PATENT DOCUMENTS

EP 1422136 A2 5/2004
KR 2016/0126500 A 11/2016

(Continued)

OTHER PUBLICATIONS

International Search Report and Written Opinion for International Application No. PCT/US2020/066353 mailed Apr. 19, 2021.

*Primary Examiner* — Daniel V Venne
(74) *Attorney, Agent, or Firm* — Bryan Wilson IP Law, PLLC

(57) ABSTRACT

A watercraft comprises a vehicle payload bay; a sail connected to the payload bay for propelling the watercraft in a foiling mode; and three or more hydrofoils connected to the payload bay. The hydrofoils are configured to provide control of the roll, pitch, and yaw of the watercraft and to elevate the vehicle payload by above a water surface when the watercraft is in the foiling mode. The hydrofoils can also provide control of roll, pitch, yaw, and elevation of the watercraft during the transition from a prone mode to a foiling mode. A mechanical propulsive system can be used for propelling the watercraft at least during transition from the prone mode to the foiling mode. The watercraft may not include a hull such that during the transition from the prone mode to the foiling mode, pitch and roll control are not substantially provided through the actions of gravity and buoyancy.

11 Claims, 5 Drawing Sheets

(58) Field of Classification Search
CPC ..... B63B 1/285; B63B 1/30; B63B 2007/003; B63B 2035/007; B63B 9/061
USPC ..... 114/274, 278
See application file for complete search history.

(56) References Cited

U.S. PATENT DOCUMENTS

| | | | | |
|---|---|---|---|---|
| 4,324,551 | A | 4/1982 | Gurries | |
| 4,579,076 | A * | 4/1986 | Chaumette | B63B 1/285 114/275 |
| 5,136,961 | A * | 8/1992 | Follett | B63B 1/248 244/45 R |
| 5,329,870 | A * | 7/1994 | Cook | B63B 1/28 114/280 |
| 6,691,632 | B2 * | 2/2004 | Stevens | B62B 15/002 114/272 |
| 7,298,056 | B2 * | 11/2007 | Gizara | F01D 25/24 114/274 |
| 9,896,162 | B2 * | 2/2018 | McClure | B63G 8/001 |
| 10,399,651 | B2 * | 9/2019 | McClure | B63G 8/001 |
| 2015/0210359 | A1 | 7/2015 | McClure | |

FOREIGN PATENT DOCUMENTS

| | | | |
|---|---|---|---|
| WO | WO-2013/101791 | A1 | 7/2013 |
| WO | WO-2021/127624 | A1 | 6/2021 |

* cited by examiner

Submerged (Evading)

Prone

Foiling (Wind or Electric)

UNMANNED TRANS-SURFACE VEHICLE

CROSS REFERENCE TO RELATED APPLICATIONS

This application is a national phase entry under 35 USC § 371 of International Application No. PCT/US20/66353 filed Dec. 21, 2020 entitled UNMANNED TRANS-SURFACE VEHICLE, which claims priority from U.S. Provisional Patent Application No. 62/951,335 filed on Dec. 20, 2019 entitled UNMANNED TRANS-SURFACE VEHICLE. The entire contents of these applications are incorporated herein by reference in their entirety.

GOVERNMENT SUPPORT

This invention was made with Government support under Agreement No. N00014-19-9-0019 awarded by Office of Naval Research (ONR). The Government has certain rights in the invention.

BACKGROUND

The present application relates generally to a type of watercraft known as unmanned trans-surface vehicles (UTVs) and, more particularly, to UTVs for fleet protection decoys and stand-in intelligence, surveillance, and reconnaissance (ISR), electronic warfare (EW), and operational support.

The Navy has long wished to leverage advances in low-cost commercial technology to support the Navy's mission and our national defense generally. In the maritime context, systems can generally be broken down into two parts: the platform and the payload. Payloads, such as radios, radars, sonars, and other systems, perform the desired mission. Platforms, such as submarines, ships, and aircraft transport payload and provide power and survivability. The cost of performing a mission includes the cost of the platform and the cost of the payload.

Until now, commercial technology has largely been seen as a way to decrease the cost of payloads. Decreases to the cost of platforms has proven elusive. Without the ability to decrease the cost of both the payload and the platform, it is difficult to generate a step change in either cost or operational strategy. For example, if it were possible to decrease the cost of a radar from $10M to $10 k (a 100× decrease), but the cost of the ship to place it on still cost $20M, the overall cost savings is only 30%. When combined with operation and maintenance costs, the cost delta becomes even less.

The primary challenge in decreasing the platform cost is the need to maintain speed, power, endurance, and survivability. These features scale poorly with decreasing vehicle size. For example, the maximum speed of standard vessels (displacement hull) in knots is given by 1.32*Sqrt (length), where the length is in feet. Thus, to go 20 knots, a vessel must be approximately 230' long. Since vessel cost scales roughly with the cube of vehicle length, creating fast, low-cost platforms is challenging. Similarly, survivability, endurance, and availability of power all scale with vessel length.

The present application discloses a new vessel concept that addresses the need for speed, power, endurance, and survivability using a combination of new technologies and conops (concept of operations) that, together, provide a viable low-cost platform that breaks the standard scaling laws and provides useful capability in a small and inexpensive platform.

BRIEF SUMMARY OF THE DISCLOSURE

In accordance with one or more embodiments, a watercraft is disclosed that is selectively operable in one of a submerged mode and a foiling mode. The watercraft comprises a vehicle payload bay; a sail connected to the payload bay for propelling the watercraft in the foiling mode; and three or more hydrofoils connected to the payload bay. The hydrofoils are configured to provide control of the roll, pitch, and yaw of the watercraft and to elevate the vehicle payload by above a water surface when the watercraft is in the foiling mode.

In accordance with one or more further embodiments, a watercraft is disclosed that is selectively operable in one of a prone mode and a foiling mode. The watercraft comprises a vehicle payload bay; a sail connected to the payload bay for propelling the watercraft in the foiling mode; three or more hydrofoils connected to the vehicle payload bay configured to provide control of roll, pitch, yaw, and elevation of the watercraft during the transition from the prone mode to the foiling mode; and a mechanical propulsive system for propelling the watercraft at least during transition from the prone mode to the foiling mode. The watercraft does not include a hull such that during the transition from the prone mode to the foiling mode, pitch and roll control are not substantially provided through the actions of gravity and buoyancy.

BRIEF DESCRIPTION OF THE DRAWINGS

Like or identical reference numbers are used to identify common or similar elements.

DETAILED DESCRIPTION

Figure 1:
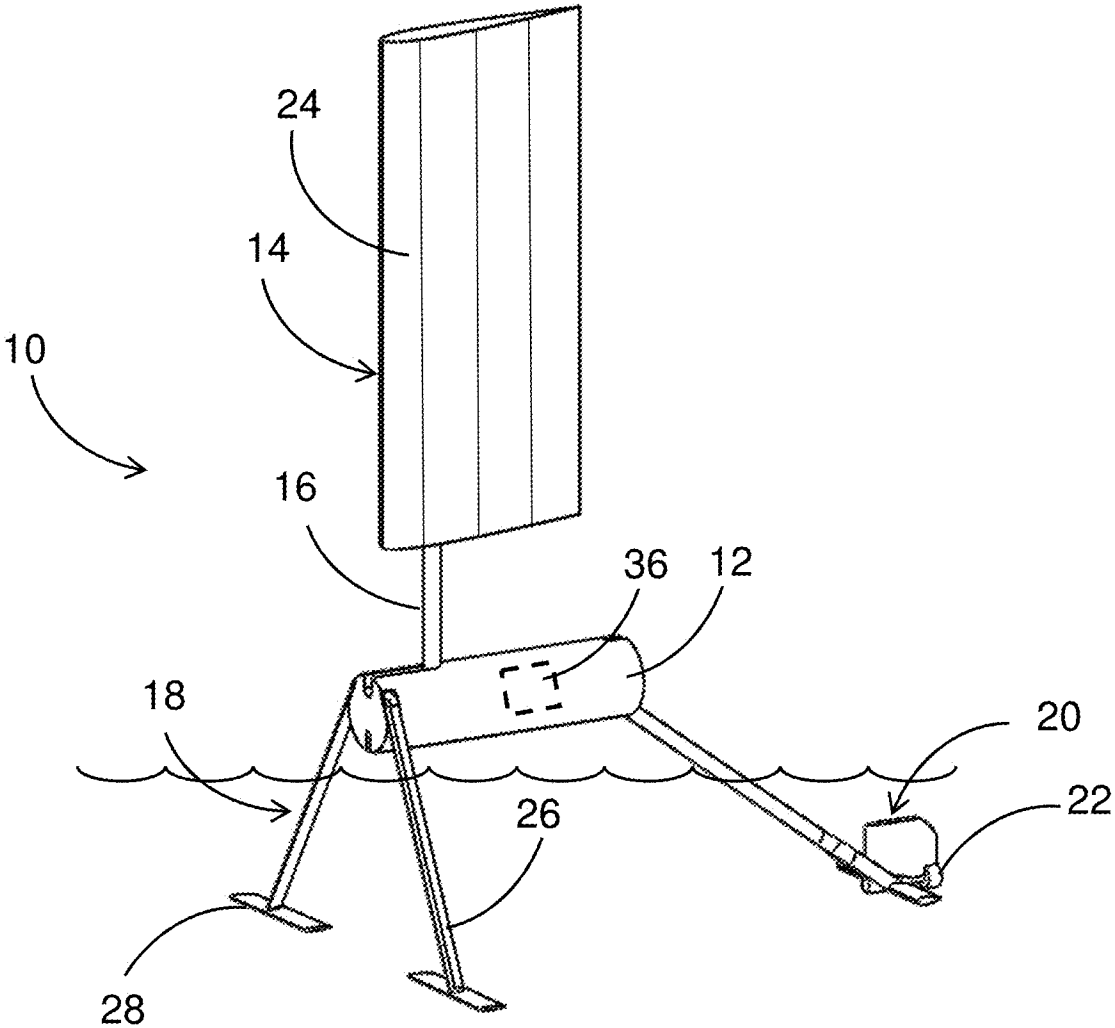
FIG. 1 illustrates an exemplary UTV in accordance with one or more embodiments in a foiling mode.

Various embodiments disclosed herein relate to a hybrid-sail/mechanical hydro-foil trans-surface vehicle. FIG. 1 illustrates one example of a UTV platform 10 in accordance with one or more embodiments. The platform 10 includes a vehicle payload bay 12, a sail and electronics platform 14, a mast 16, forward hydrofoils 18, rear control surfaces 20, and a hybrid-electric propulsion and generation system 22.

The vehicle payload bay 12 contains vehicle control electronics, batteries, the payload, and other systems required for vehicle operation. In an exemplary embodiment, the payload bay 12 is sized to fit within a standard Mark 48 torpedo tube.

The sail and electronics platform 14 includes a rigid sail 24, which provides the vehicle primary propulsion, and also provides space aloft to house antennas and other sensors and EW packages. In this embodiment, the sail 24 is a rigid carbon-fiber composite airfoil comprised of four vertical sections that nest when stowed. Thus, by nesting the vertical sections and rotating the mast 16 forward the sail 14 can be stowed within the form-factor of a Mark 38 torpedo. In the exemplary embodiment depicted, the sail area is approximately 5 square meters, which is comparable to a sail for a windsurfer.

In one or more alternate embodiments, the sail 24 comprises a furling sail.

The mast 16 can be a carbon fiber composite tube. The mast 16 is stepped in the main payload bay 12. In this embodiment, the mast 16 is actuated at the vehicle payload bay 12 to adjust the angle of attack of the sail 24. Alternately, the sail 24 can rotate freely, and the angle of attack can be adjusted with control surfaces, using methods known to those skilled in the art. In this exemplary embodiment, the mast 16 is shown at mounted to the sail 24 at approximately the %-chord point to minimize rotational (yaw) moments.

The forward hydrofoils 18 are control surfaces comprising two largely vertical foils ('pylons' or centerboards) 26 and two horizontal foils (ailerons) 28. In this exemplary embodiment, when stowed the hydrofoil pylons 26 rotate forward and the foils 28 rotate parallel to the pylons 26, enabling the assembly to be contained within the form factor of a tube, e.g., a Mark 28 torpedo tube. This assembly provides services, including windward lift, vertical lift, and windward roll.

Figure 4:
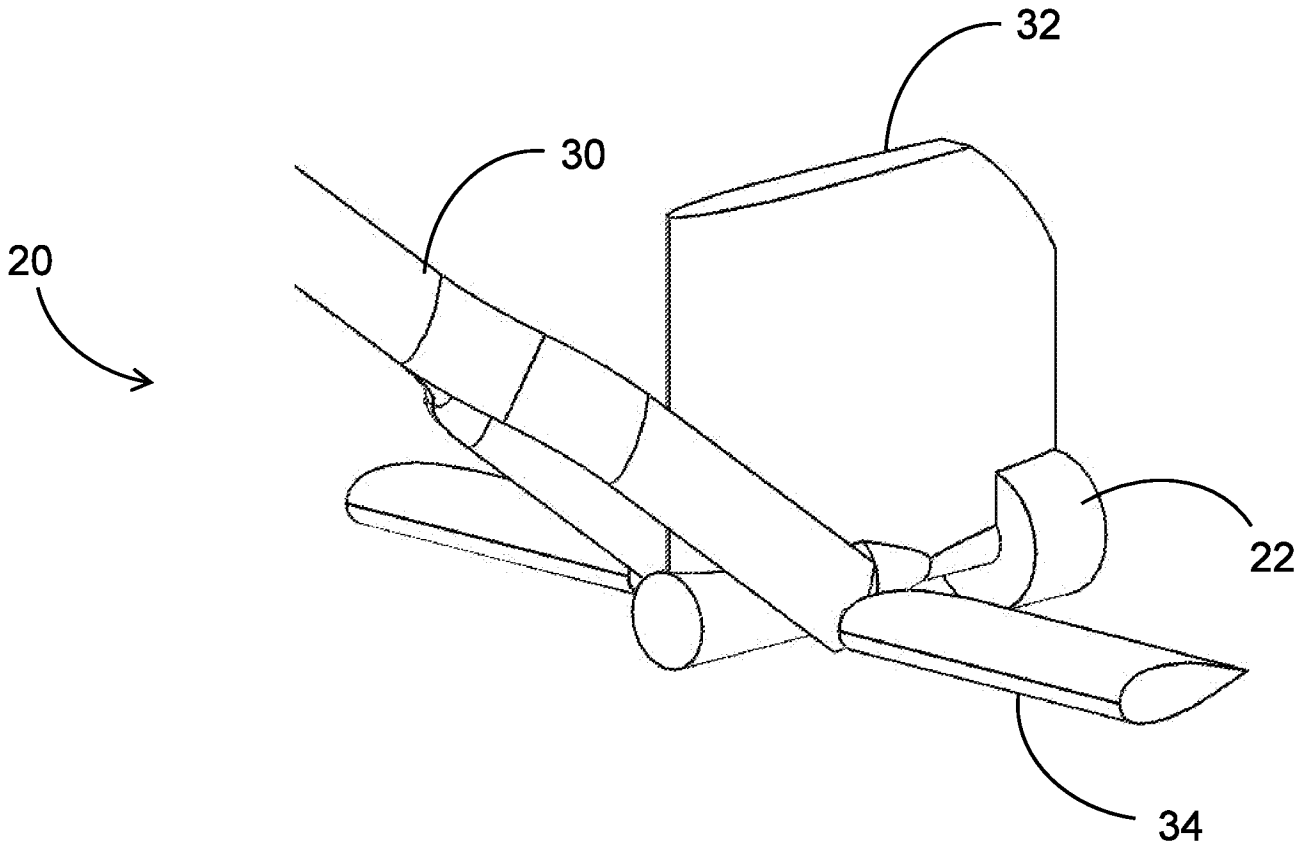
FIG. 4 is an enlarged view illustrating details of the rear control surfaces and hybrid-electric propulsion and generation system of the UTV in accordance with one or more embodiments.

As shown in FIG. 4, the rear control surface assembly 20 comprises a pylon (and vertical stabilizer) 30, a vertical surface (stabilizer and rudder) 32, and a horizontal stabilizer and elevator 34. In this exemplary embodiment, the assembly 20 rotates both forward and aft/vertically. When rotated forward the pylon 30 fits within a slot on the vehicle payload bay 12 and the entire assembly then fits within the form factor of a Mark 28 torpedo tube. The assembly 20 provides three principle services: vehicle directional stability, directional control, and pitch control.

When in wind-powered foiling mode, the 'lift' generated by the sail 24 acts substantially horizontally to leeward and either forward or aft depending on the relationship between the vehicle's motion and the surrounding airmass (the 'point of sail'). This 'lift' pulls the vehicle to leeward. Further, because the sail 24 is above both the center of mass and the center of drag of the vehicle 10, this horizontal lift generates both a leeward roll moment, and either forward or aft pitching moment on the vehicle 10.

To enable the vehicle 10 to track in a substantially forward direction, the leeward horizontal force generated by the sail 24 is offset by a windward horizontal force generated by the vertical pylons 26 that are designed to operate like the centerboard or keel on a sailboat. Using the rudder 32, the angle of attack between the oncoming water and the vertical pylons 26 is adjusted, thereby controlling the windward lift.

With respect to vertical lift and the control of vehicle elevation, during foiling operation, the ailerons 28 work in concert with the elevators 34 to lift the vehicle payload bay 12 out of the water to a substantially constant elevation above the water surface. This is achieved by a combination of (1) adjusting the overall vehicle angle of attack using the elevators 34, or (2) operating left and right ailerons 28 and elevator 34 in tandem to adjust their individual angles of attack. Though the individual lift generated by each surface may be varied (or even be in opposition), the net lift must be sufficient to counteract vehicle weight (adjusted for any potential buoyancy) so as to hold the vehicle 10 at the desired elevation.

Roll control is provided using one or more of the ailerons 28. As noted, the ailerons 28 and elevator 34 must provide, in combination, sufficient net lift to counteract weight and hold the vehicle 10 at the desired elevation. As the ailerons 28 are offset from the vehicle center of mass, the ailerons 28 can be operated differentially to provide vehicle roll control. As discussed above, during wind-power foiling operation, the lift generated by the wing 24 pulls the wing to leeward, thereby inducing a leeward rolling moment. As the leeward aileron is leeward of the center of mass of the vehicle 10, the leeward aileron can induce a windward rolling moment counteracting the leeward moment of the wing 24. Similarly, the windward aileron can provide a windward rolling moment by generating a downward force. However, in this case, the net lift generated by the ailerons 28 and elevators 34 would still need to be sufficient to overcome the weight of the vehicle 10. One skilled in the art will appreciate that if one side of the vehicle 10 is always the leeward side then only one aileron 28 is technically required to provide both sufficient lift (along with the elevator 34) and to provide windward rolling moment. However, two ailerons 28 are generally required to enable operation on both starboard tack (wind to starboard) and port tack (wind to port).

Pitch control is provided using the combined action of the ailerons 28 and the elevator 34. As noted, the ailerons 28 and elevator 34 must provide, in combination, sufficient total lift to counteract weight and hold the vehicle 10 at the desired elevation. Through differential control of the ailerons 28 and elevator 34, the pitch of the vehicle 10 can be controlled. During wind-powered foiling operation, the lift generated by the wing 24 will pull the vehicle 10 either forward or aft depending upon the point of sail 24. As the wing 24 is above the center of mass and drag of the vehicle 10, this will induce a pitching moment in the vehicle 10. This pitching moment is offset as described using the ailerons 28 and elevators 34.

With respect to yaw control, the rudder 32 is positioned aft of the center of mass and drag of the vehicle 10. Action of the rudder 32 thereby generates a yawing motion on the vehicle 10.

Many embodiments will also include a propulsion system 22. This propulsion system 22 may optionally comprise an electromotive system, such as an electromechanical propulsion system, or a hybrid electric propulsion and generation system. Activation of the propulsion system 22 uses energy from the batteries to propel the vehicle 10. When in generation mode, motion of the vehicle 10 through the water (for example, from sail power) results in generation of electricity to charge batteries and provide payload power.

The design and operation of the sail and various hydrofoils will be understood by one skilled in the art.

Figure 2A:
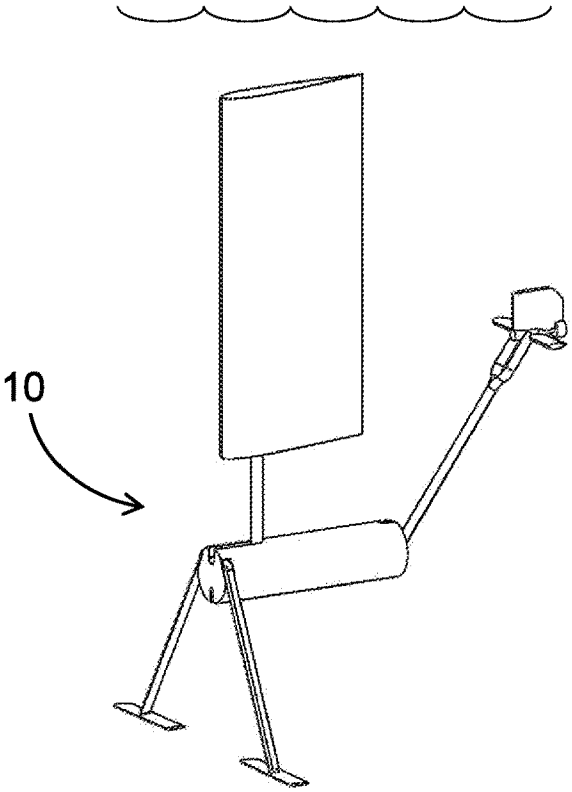
FIGS. 2A, 2B, and 2C illustrate the UTV in submerged, prone, and foiling modes of operation, respectively, in accordance with one or more embodiments.
Figure 2B:
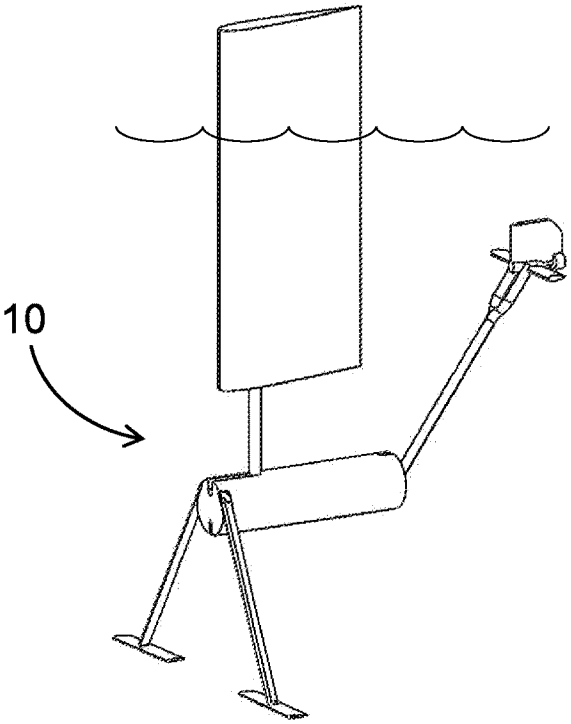
Figure 2C:
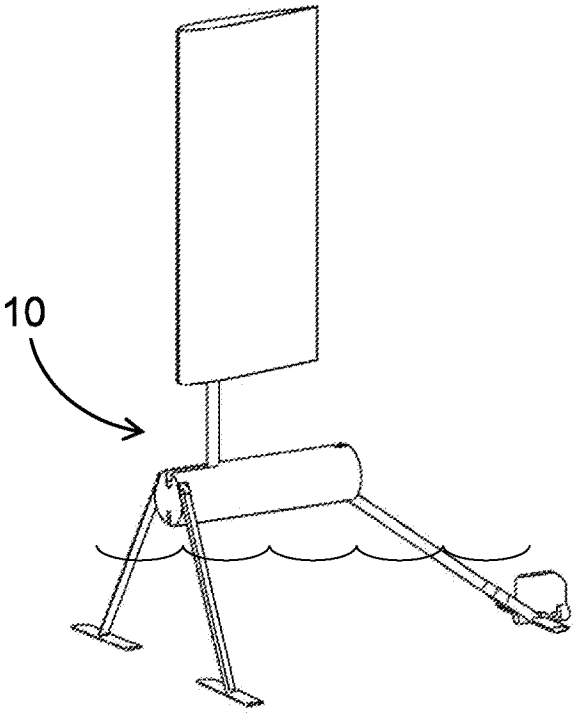

UTVs 10 in accordance with various embodiments can operate in one of several modes, as depicted in FIGS. 2A, 2B, And 2C. These modes include a foiling mode, a prone mode, and a submerged mode.

In the foiling mode shown in FIG. 2C, the vehicle payload bay 12, mast 16 and sail 24 ride above the water surface, supported by the forward and rear foiling surfaces 28, 34. This is the primary operational mode of the platform 10. Propulsion can be provided either by the wind acting on the sail 24, or by the action of the propulsion system 22. If propelled by the wind, the hybrid electric propulsion system 22 can be disengaged, or it can be engaged to convert forward motion of the vehicle 10 into electric energy to recharge the batteries or for use by the payload. In this embodiment, the rudder assembly 32 is held aft so as to improve directional stability and increase the purchase of the rudder and elevator control surfaces 32, 34. The vehicle 10 is held a generally constant distance over the water surface either passively or actively. If so designed, the v-shaped forward foils 18 will passively hold the vehicle 10 a set distance over the water. As the vehicle 10 rises, more of the foils 18 will come out of the water, thereby decreasing the lifting force provided by the foils. It is anticipated that most embodiments will use active control, measuring the height of the Vehicle Payload Bay 12 over the water surface using one of several available means, and then actively controlling the vehicle height through coordinated action of the forward horizontal foils 28 and elevator 34.

FIG. 2B depicts the vehicle 10 in the prone mode. The vehicle may remain in prone mode for a substantial period of time or may pass through a prone mode momentarily in transition from submerged to foiling modes, or vice versa. In the exemplary embodiment, the vehicle 10 does not have a conventional hull, nor does it have a keel. With dinghies, a beamy hull provides lateral roll stability and keeps the sail 24 upright when the vehicle 10 is not moving or is moving at insufficient velocity for the control surfaces to be effective. Similarly, with keelboats, a heavy keel below the waterline keeps the boat and sail upright. While either approach could, in principle, be used here, this embodiment has neither a hull, nor a keel so as to enable to vehicle 10 to fold compactly, e.g., into a Mark 48 torpedo tube.

The vehicle 10 is designed to have its first neutral buoyancy point with approximately one meter of sail protruding from the water. At this point, the weight of the vehicle 10 above the waterline is offset by the positive buoyancy of the portion of the vehicle 10 below the waterline. Stability in this configuration is achieved by loading buoyancy in the mast 16 and leaving the vehicle payload bay 12 negatively buoyant. This so-called 'prone' operating mode depicted in FIG. 2B allows sensors and communications means mounted on the tip of the sail 24 to be operational but minimizes the profile and thus visibility of the vehicle 10. When in the prone mode, the rudder-elevator assembly 20 and propulsion system 22 can be rotated into an upward configuration, moving the center of thrust in line with the center of drag. This improves the maneuverability of the vehicle 10 while the bulk of the vehicle 10 is underwater.

The UTV 10 may also operate in a fully submerged mode as depicted in FIG. 2A. This mode enables the vehicle 10 to evade capture if unable to outrun or out maneuver adversaries. It also allows the platform 10 to descend below the wave action so as to be able to ride out significant meteorological events. In this embodiment, the vehicle 10 is envisioned as descending to a second stable buoyancy point at about 100'-200' below the surface. In this configuration, the rudder assembly 20 is assumed to be in the upper configurations, similar to the prone mode.

In design of the vehicle 10, consideration must be given to the performance of the vehicle 10 as it transitions from one mode to another.

Submerged to Prone Transition. The vehicle 10 is designed to have positive buoyancy in the prone configuration, which is balanced by the weight of the portion of the mast 16 above the waterline. Further, the vehicle 10 is designed to have neutral (negatively stable) buoyancy a short distance below the water surface, and neutral (positively stable) buoyancy at its target submerged depth (e.g., 200'). This is accomplished through use of both collapsible and rigid buoyancy devices 36, which can be housed in the vehicle payload bay 12, in appropriate combination. Rigid devices exhibit positive stability, in that if they are put in water they will naturally ascend or descend until they achieve neutral buoyancy. On the other hand, collapsible devices exhibit a negative buoyancy stability characteristic. If above their neutrally buoyant point, collapsible devices become more buoyant as they ascend. Similarly, collapsible devices become less buoyant as they descend past their neutrally buoyant point. Thus, once they begin to move, collapsible devices will either rise or sink from their neutral buoyancy point until they either burst, become rigid, or are fully collapsed. In the prone configuration, the vehicle 10 is designed so that both rigid and collapsible devices are inflated, and the vehicle 10 exhibits positive buoyancy, thereby holding a portion of the sail 24 out of the water. Thus, while positively buoyant, the vehicle 10 is stable in this configuration. Next, the vehicle 10 is designed so that the neutral buoyancy point is a short distance below the surface, such that the vehicle 10 is able to propel itself down past the neutral buoyancy point. Once below the neutral buoyancy point, the vehicle 10 will descend without power until the collapsible devices are fully collapsed. At that point the vehicle 10 will find its second neutrally buoyant point. When ascending, the vehicle 10 propels itself electrically upwards until it reaches the neutral buoyancy point. At that point the vehicle 10 will rise on its own to the surface of the water.

Prone to Foiling Transition. Transition from prone (e.g., stationary) to foiling modes can be caused by action of the wind acting on the sail 24, or by the forward motion generated by the propulsion system 22. If the wind is used, then, as noted, the force generated by the wind on the sail 24 induce pitch and roll moments. A vessel with one or more hulls can use the buoyant force generated by the hull (offset from the center of mass) to offset these moments until such time as the vehicle has sufficient forward speed that the ailerons 28, elevators 34, and rudder 32 become effective. Once effective these control surfaces can provide pitch, roll and yaw control. In place of a hull, the vehicle 10 can include weights, floats, or other to provide roll and pitch control. In place of a hull, a vehicle can achieve the same effect through a combination of weights and floats, some of which are offset from the center of mass of the vehicle.

A vehicle without a hull or offset weights or floats cannot utilize buoyancy to maintain pitch and roll control during the prone to foiling transition. Such vehicles, such as the current embodiment, utilize a propulsion system generate the initial forward motion required to render the ailerons 28, elevators 34, and rudder 32 effective. Once these control surfaces become effective they can provide roll, pitch and yaw control, the vehicle 10 can be caused to rise out of the water, and the sail 24 can be brought online and used to drive further acceleration of the watercraft. Either before or during this transition, the rear elevator assembly 20 is rotated into the aft/down configuration.

The transition from foiling to prone is more straight forward. The vehicle 10 is brought down towards the water. Water drag over the vehicle payload bay 12 slows the vehicle 10 and it sinks into the prone configuration. The elevator assembly 20 is moved into the up configuration if desired to facilitate motion in the prone state.

Figure 3:
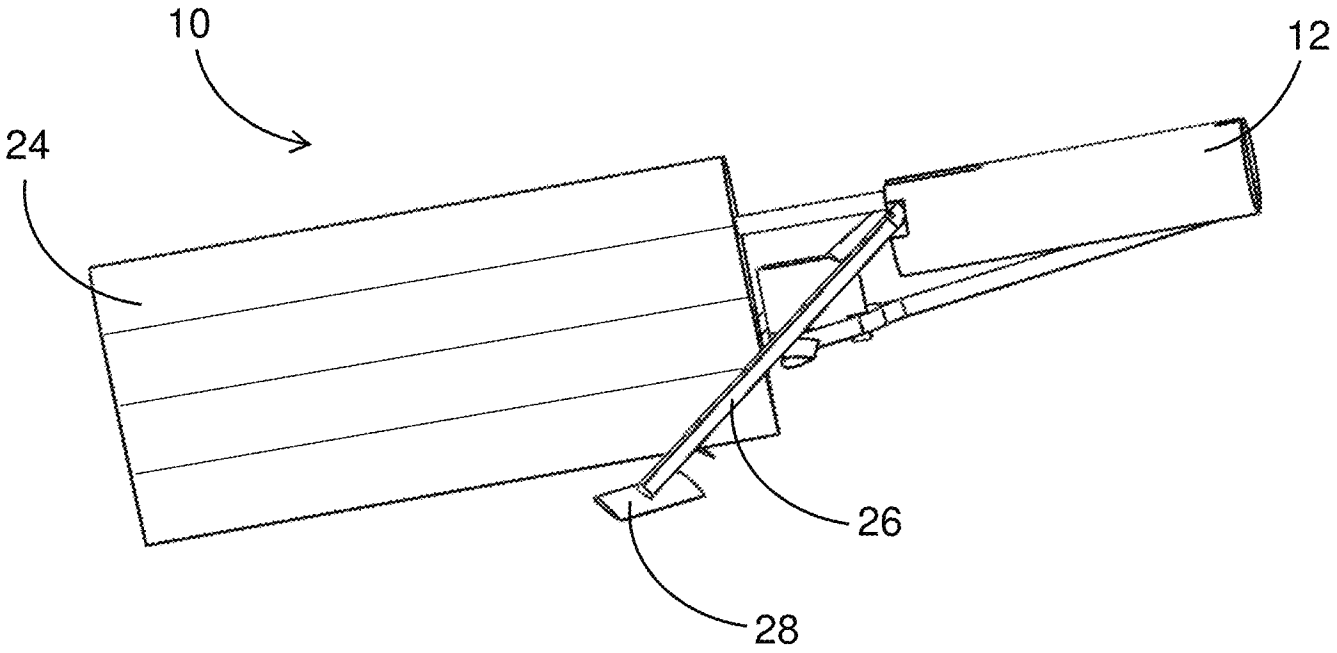
FIG. 3 illustrates the UTV in a partially stowed configuration in accordance with one or more embodiments.

The vehicle 10 can also be designed with a stowed configuration. A partially stowed vehicle 10 is shown in FIG. 3. This embodiment of the vehicle 10 is designed to fit within the form factor of a Mark 48 torpedo tube. In FIG. 3, the front pylons 26 are shown rotated forward. To continue stowing the front pylons 26, the ailerons 28 are stowed parallel to the pylons 26. Similarly, the rear assembly 20 is folded forward. In this design the elevators 34 are able to fit within the torpedo tube form factor without additional disassembly. In the figure, the rudder is shown slightly too large, as it would interfere with folding of the mast 16. The mast 16 and sail 24 can fold forward, with the base of the sail clearing the font of the elevator. The sail 24 itself comprises four vertical sections. The front sail section hinges open slightly and collapses to the mast 16. The three rear sections nest, each within the next. The entire mast assembly 16 then fits within the form factor of the Mark 48 torpedo tube. (Various components of the UTV are shown conceptually, and it should be understood that the components can be designed to be foldable as discussed.) Unfolding of the sail assembly 24 can be accomplished through any number of available means. One method uses material that expands when put in contact with water. The expanding material forces the wing into its assembled configuration where it then locks in place.

Figure 5B:
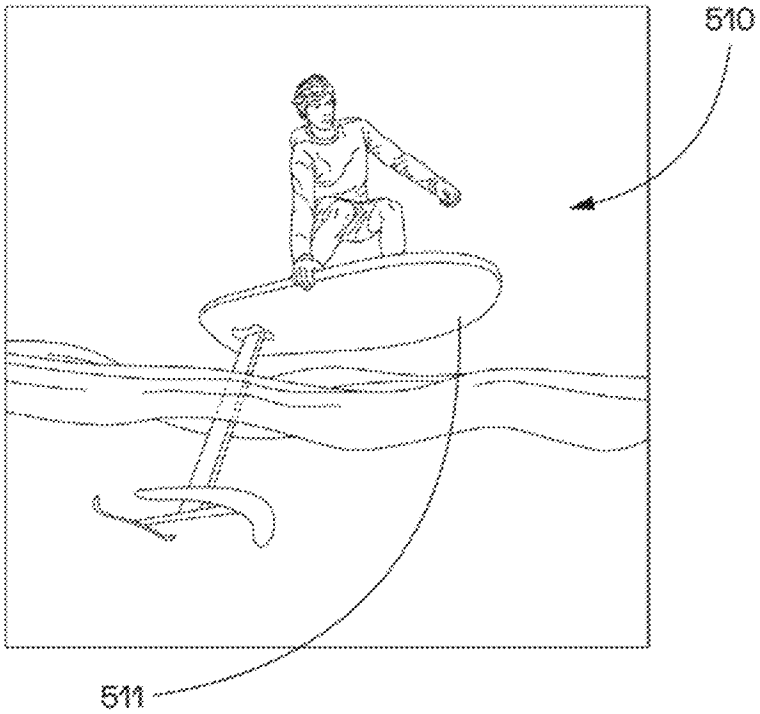
FIG. 5B Prior Art
FIGS. 5A and 5B illustrates example of commercially available wind-powered and electric-powered foiling vehicles at the approximate scale as an exemplary UTV in accordance with one or more embodiments.
Figure 5A:
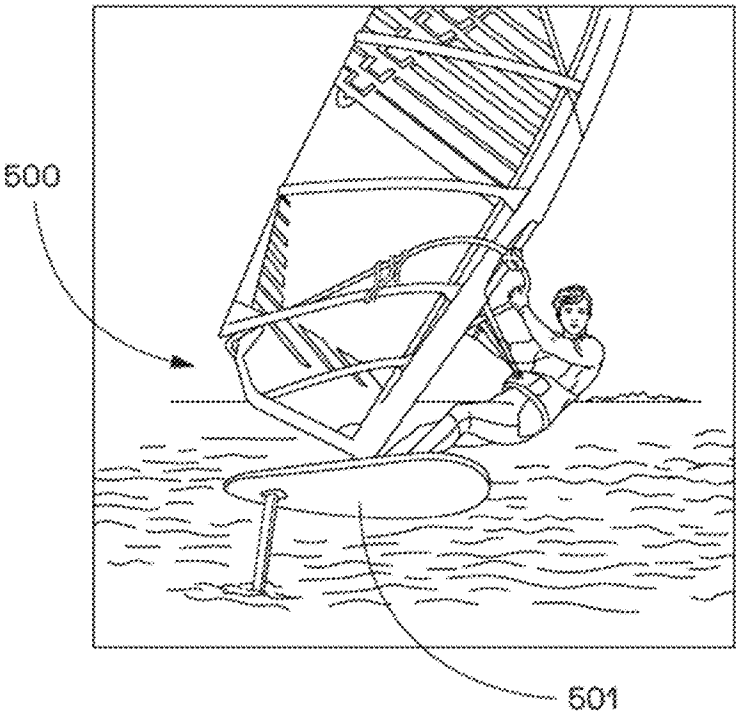
FIG. 5A Prior Art

As outlined above, the primary challenge in creating a useful, low-cost platform is achieving sufficient vehicle speed in a small platform. The commercial vehicles 500, 510 shown in FIGS. 5A and 5B demonstrate that vehicle of the scale disclosed herein can be successfully manufactured at low cost and can achieve significant speeds. Planning windsurfers have achieved speeds in excess of 55 knots. A more typical speed for a foiling windsurfer 501 shown in FIG. 5A is just under 30 knots in about 20 knots of wind. These speeds are sufficient to keep up with and mimic the motion of the fleet for decoy operations, are sufficient to perform sensor sweeps of large areas (e.g. sonar), and sufficient to outrun and out maneuver pursuing displacement hulls. Similarly, electric foiling surfboards 511 shown in FIG. 5B are available from multiple manufacturers. Riding times of 60-90 minutes are typical with quoted speeds of more than 20 knots.

Further, the integration of a hybrid-electric system enables the vehicle 10 considerable residual mobility in no-wind conditions, and significant power availability, and endurance, when wind is present. Finally, the ability to submerge provides a critical ability to evade capture and ride out adverse weather conditions. A submerged depth of 100' to 200' is sufficient to evade capture and ride out storms, while also being consistent with depth conditions experienced by technical SCUBA divers, and thus accessible using equipment manufactured with commercial manufacturing practices.

Having thus described several illustrative embodiments, it is to be appreciated that various alterations, modifications, and improvements will readily occur to those skilled in the art. Such alterations, modifications, and improvements are intended to form a part of this disclosure, and are intended to be within the spirit and scope of this disclosure. While some examples presented herein involve specific combinations of functions or structural elements, it should be understood that those functions and elements may be combined in other ways according to the present disclosure to accomplish the same or different objectives. In particular, acts, elements, and features discussed in connection with one embodiment are not intended to be excluded from similar or other roles in other embodiments. Additionally, elements and components described herein may be further divided into additional components or joined together to form fewer components for performing the same functions. Accordingly, the foregoing description and attached drawings are by way of example only, and are not intended to be limiting.

What is claimed is:

1. A watercraft that is selectively operable in one of a submerged mode and a foiling mode, the watercraft comprising:

a vehicle payload bay;

a sail connected to the vehicle payload bay for propelling the watercraft in the foiling mode;

three or more hydrofoils connected to the vehicle payload bay, the hydrofoils configured to provide control of a roll, a pitch, and a yaw of the watercraft and to elevate the vehicle payload bay above a water surface when the watercraft is in the foiling mode; and a hybrid-electric propulsion and generation system configured to propel the watercraft in the submerged mode and generate electricity from movement of the watercraft, wherein the sail comprises a rigid sail having a plurality of sections that nest when stowed, and wherein the watercraft is configured to be foldable to fit within a torpedo tube.

2. The watercraft of claim 1, further comprising a mast connecting the sail to the payload bay.

3. The watercraft of claim 1, further comprising a buoyancy system configured to provide neutral buoyancy of the water craft at a first neutral buoyancy point relative to a water surface.

4. The watercraft of claim 3, further comprising a buoyancy system configured to provide neutral buoyancy of the watercraft at a second neutral buoyancy point relative to the water surface.

5. The watercraft of claim 1, wherein the rigid sail comprises a carbon-fiber composite airfoil.

6. A watercraft that is selectively operable in one of a prone mode and a foiling mode, the watercraft comprising:

a vehicle payload bay;

a sail connected to the vehicle payload bay for propelling the watercraft in the foiling mode;

three or more hydrofoils connected to the vehicle payload bay configured to provide control of a roll, a pitch, a yaw, and an elevation of the watercraft during a transition from the prone mode to the foiling mode;

a propulsive system for propelling the watercraft at least during transition from the prone mode to the foiling mode; and a system for generating electricity from movement of the watercraft, p1 wherein the watercraft does not include a hull such that during transition from the prone mode to the foiling mode, pitch and roll control are not substantially provided through actions of gravity and buoyancy, wherein the watercraft is configured to be foldable to fit within a torpedo tube, and wherein the sail comprises a rigid sail, and wherein the watercraft is further selectively operable in a submerged mode with neutral buoyancy.

7. The watercraft of claim 6, wherein the propulsive system provides motive force during at least prone mode.

8. The watercraft of claim 6, wherein said propulsion system comprises an electromechanical propulsion system.

9. The watercraft of claim 6, wherein the rigid sail comprises a carbon-fiber composite airfoil.

10. The watercraft of claim 6, wherein the rigid sail comprises a plurality of sections that nest when stowed.

11. The watercraft of claim 3, wherein the buoyancy system comprises collapsible buoyancy devices.

* * * * *